United States Patent [19]

Chiodo et al.

[11] 4,048,741

[45] Sept. 20, 1977

[54] ROTATION-PREVENTING LOCK ASSEMBLY

[76] Inventors: Daniel J. Chiodo, 14730 Harris Place, Miami Lakes; Charles S. Alvarez, 5735 N.W. 14 Ave., Hialeah, both of Fla.

[21] Appl. No.: 709,657

[22] Filed: July 29, 1976

[51] Int. Cl.[2] ..... F41C 27/00

[52] U.S. Cl. ..... 42/1 LP

[58] Field of Search ..... 42/1 LP, 66, 59

[56] References Cited

U.S. PATENT DOCUMENTS

| | | | |
|---|---|---|---|
| 2,327,334 | 8/1943 | Parker | 42/1 LP |
| 2,479,107 | 8/1949 | Garretson | 42/1 LP |
| 2,887,807 | 5/1959 | Santangelo | 42/1 LP |
| 2,943,411 | 7/1960 | Salva | 42/66 |
| 3,022,598 | 2/1962 | Wikstrom | 42/1 LP |
| 3,027,674 | 4/1962 | Mahan | 42/1 LP |
| 3,360,880 | 1/1968 | Finnegan | 42/1 LP |
| 3,708,901 | 1/1973 | Wolter | 42/1 LP |

*Primary Examiner*—Charles T. Jordan
*Attorney, Agent, or Firm*—Oltman and Flynn

[57] ABSTRACT

The present lock assembly is to prevent rotation of a gun cylinder or similar rotatable body. The lock assembly has a housing that is slidably insertable into a chamber in the gun cylinder from the back end. An eccentric lock at the front end of the lock housing is slidably insertable through the cylinder chamber, after which it may be turned to a locking position in front of the cylinder by a key inserted into the back end of the lock housing. Within the lock housing an off-center shaft carries the eccentric lock and cooperates with a spring-biased release slide for operation by the key to turn the eccentric lock between its "unlock" and "locking" positions. A fixed projection on the back end of the lock housing is disposed outside the back end of the cylinder for engagement with the gun body to prevent the cylinder from turning.

15 Claims, 14 Drawing Figures

ROTATION-PREVENTING LOCK ASSEMBLY

BACKGROUND OF THE INVENTION

Various arrangements have been proposed heretofore for preventing the inadvertent firing of a gun. Examples of such prior proposals are disclosed in the following U.S. patents: Parker U.S. Pat. No. 2,327,334; Santangelo U.S. Pat. No. 2,887,807; Salva U.S. Pat. No. 2,943,411; Wikstrom U.S. Pat. No. 3,022,598; Mahan U.S. Pat. No. 3,027,674; Robbins et al. U.S. Pat. No. 3,085,360; Giles U.S. Pat. No. 3,208,176; Finnegan U.S. Pat. No. 3,360,880; and Lentz U.S. Pat. No. 3,368,297.

SUMMARY OF THE INVENTION

The present invention is directed to a lock assembly for preventing the inadvertent firing of a gun by locking the gun cylinder against being rotatively indexed to a position in which the gun can be fired.

While this lock assembly is specifically designed for attachment to a gun cylinder, it may also be used to prevent the rotation of a rotatable part on a different type of apparatus or device than a gun.

In the preferred embodiment, the present lock assembly has a housing of stepped cylindrical configuration that may be slidably inserted into a chamber of the gun cylinder from the back end. Inside the lock housing are a rotatably and axially displaceable off-center shaft and a release slide cooperating with that shaft. An eccentric lock is located in front of the lock housing and is connected to the off-center shaft to be turned by that shaft between a retracted "unlock" position, in which it is slidable through the cylinder chamber, and an extended "locking" position, in which it prevents the withdrawal of the lock assembly from the cylinder, as well as preventing the cylinder from turning. The off-center shaft and the release slide are operated by a key inserted into the back end of the lock housing. The lock housing also carries a fixed projection that extends behind the cylinder to prevent the cylinder from being turned.

A principal object of this invention is to provide a novel and improved lock assembly for preventing the rotative indexing of a rotatable part in a mechanical device.

Another principal object of this invention is to provide a novel and improved lock assembly for preventing a gun cylinder from being turned to its firing position.

Further objects and advantages of this invention will be apparent from the following detailed description of a presently-preferred embodiment thereof, which is shown in the accompanying drawings, in which.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
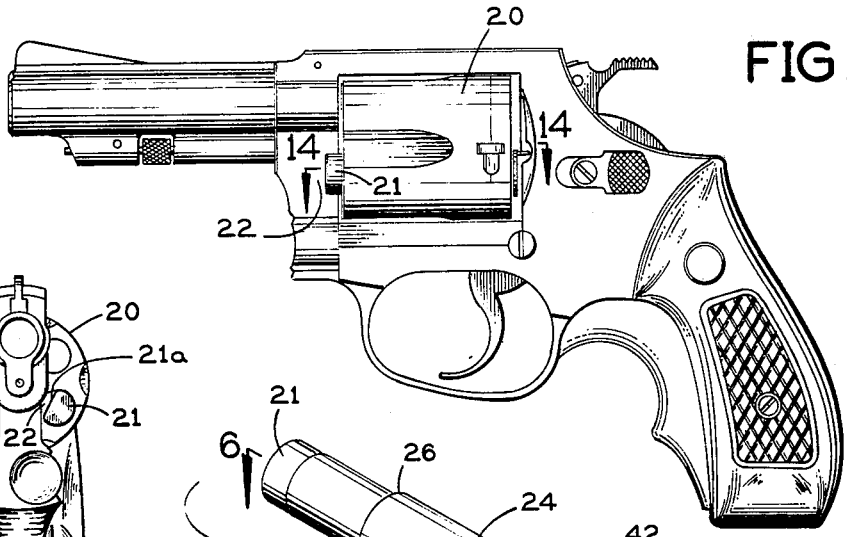
FIG. 1 is a side elevational view of a pistol having a cylinder carrying the present lock assembly.
Figure 2:
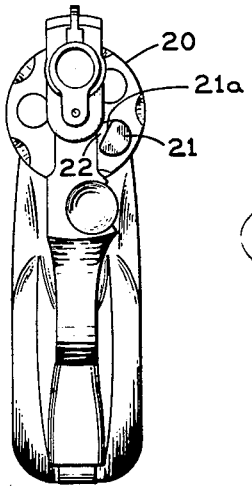
FIG. 2 is a front elevational view of this pistol.

Referring first to FIG. 1, the lock assembly of the present invention is mounted in one chamber of the usual cylinder 20 on a pistol of conventional design. As shown in this Figure and in FIG. 14, this lock assembly presents an eccentric lock 21 located just beyond the front end of the cylinder. A portion of this eccentric lock projects transversely across the front end of the cylinder (FIG. 14) to prevent the withdrawal of the lock assembly from the cylinder. In this positon the eccentric lock 21 also is engageable with the body 22 of the pistol to prevent the usual rotation of the cylinder 20 into a position in which the gun may be fired.

Figure 3:
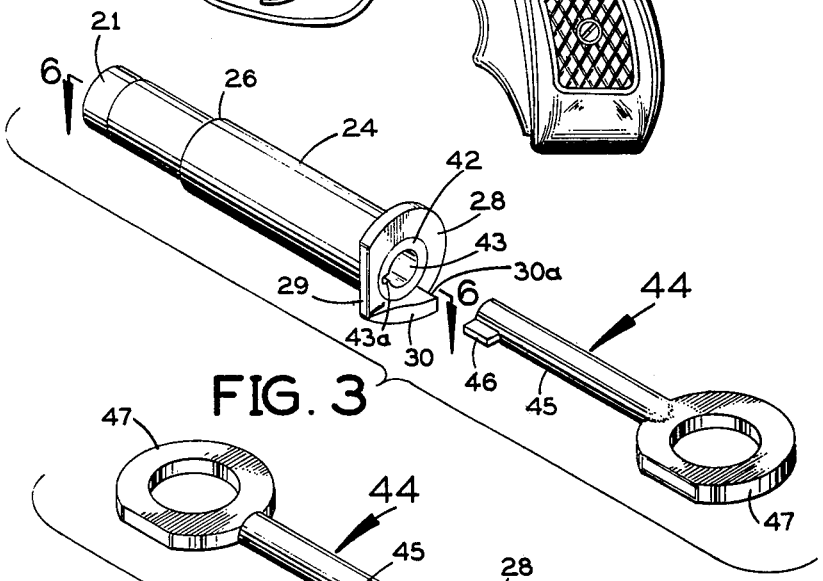
FIG. 3 is an exploded perspective view of the present lock assembly and the key for operating it, viewed from the back end of the lock assembly.
Figure 14:
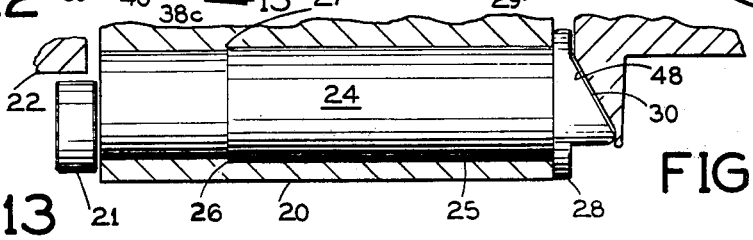
FIG. 14 is a longitudinal section through the cylinder chamber with the present lock assembly in place and in its "lock" condition.

The lock assembly includes a housing 24 of stepped cylindrical configuration which is snugly but slidably received in a cylinder chamber 25. The lock housing presents a forwardly-facing, transverse, annular, external shoulder 26 which abuts against a corresponding rearwardly-facing, transverse, annular, internal shoulder 27 in the cylinder chamber, as shown in FIG. 14. At its rear end the lock housing has an integral, tranverse flange 28 that abuts against the back end of the cylinder 20 around the cylinder chamber 25 which receives the lock housing. This flange 28 has a cylindrical periphery for most of its extent but at one side it is cut away to present a flat surface 29, as best seen in FIG. 3. As integral extension 30 has an inclined back face projecting rearwardly from the flange 28 at the lower end of its flat 29 in this Figure. At its front end the lock housing 24 presents a transverse end wall 31 (FIG. 6) with a circular longitudinal bore 32 which is offset laterally from the longitudinal axis of this housing.

A shaft 33 of stepped cylindrical configuration is rotatably received in the off-center bore 32 formed in the front wall 31 of the lock housing. The eccentric lock 21 is fixedly attached, such as by brazing, to the front end of shaft 33 in front of the lock housing's front end wall 31. At its back end the off-center shaft 33 presents a socket 34 of cylindrical configuration and longitudinal slots 35 and 36 at the top and bottom, respectively, of this socket. The slots are open at the back end of shaft 33. Near its back end the shaft 33 presents forwardly-facing, transverse, external shoulders 33*a* (FIG. 6) which extend arcuately between the slots 35 and 36 near the inner ends of these slots. Shaft 33 also presents a forwardly-facing, transverse, annular, external shoulder 37 for engagement against the rear face of the front wall 31 of the lock housing 24 when the shaft is displaced axially along the housing from the normal, retracted position, shown in FIGS. 6 and 9, to the forward, extended position, shown in FIGS. 10 and 12.

An annular release slide 38 has a circular central bore 38*b* which slidably receives the cylindrical segment of the off-center shaft 33 immediately in front of the arcuate shoulders 33*a* on this shaft. The release slide has a close sliding fit in the cylindrical bore 24' of the lock housing 24. At the bottom in FIG. 6 the release slide has an external longitudinal slot 39 which is open at the front end of the release slide. The lock housing 24 carries a dowel pin 40 which projects radially into slot 39 to guide the release slide 38 when it is displaced longitudinally of the lock housing and to prevent the release slide from turning in the lock housing.

Figure 8:
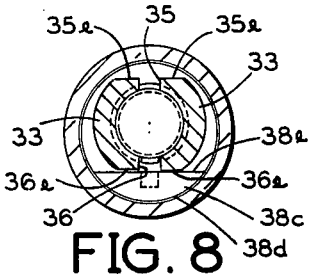
FIG. 8 is a cross-section taken along the line 8–8 in FIG. 6.

Behind its slot 39 the release slide presents a rearwardly projecting lip 38*c* (at the bottom in FIG. 6) with a cross-sectional shape which is a segment of a circle, presenting an arcuate peripheral face 38*d* on the bottom (FIG. 8), which is an extension of the cylindrical periphery of the slide, and a transverse flat top face 38*e*. The enlarged back end of the off-center shaft 33 has flat surfaces 36*e* on opposite sides of the slot 36 which slidably engage the flat surface 38*e* on the rear extension 38*c* of the release slide in the position of the parts shown in FIGS. 6 and 8. Similarly, the enlarged back end of shaft 33 has flat surfaces 35*e* on opposite sides of its slot 35 which slidably engage surface 38*e* on the release slide when the shaft is rotated one-half turn from the position shown in FIGS. 6 and 8, as explained hereinafter.

Near the front end of its rearwardly projecting lip 38*c*, the release slide presents a rearwardly-facing, transverse, arcuate shoulder 38*a* (FIG. 6) which is engageable by the forwardly-facing shoulders 33*a* on shaft 33 to enable the release slide 38 to retract the shaft 33 after it has been displaced forward, as explained hereinafter.

Figure 6:
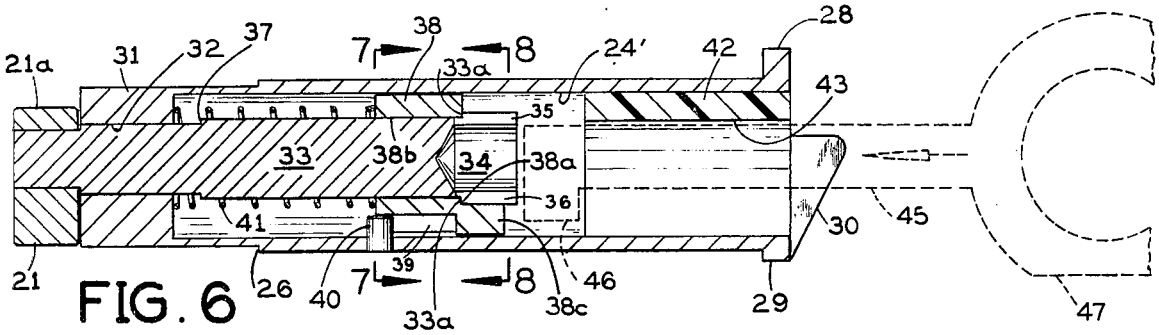
FIG. 6 is a horizontal longitudinal section through the lock assembly in its "unlock" condition.
Figure 9:
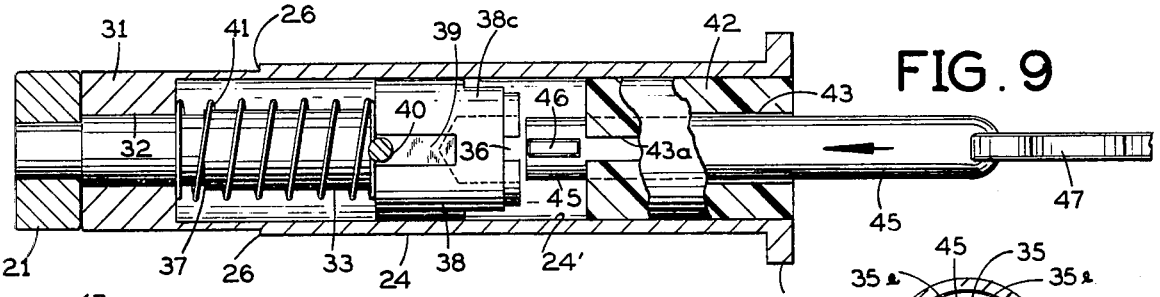
FIG. 9 is a vertical longitudinal secton corresponding to FIG. 6.
Figure 7:
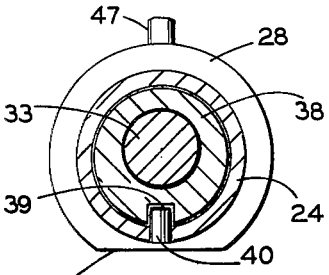
FIG. 7 is a cross-section taken along the line 7—7 in FIG. 6.
Figure 10:
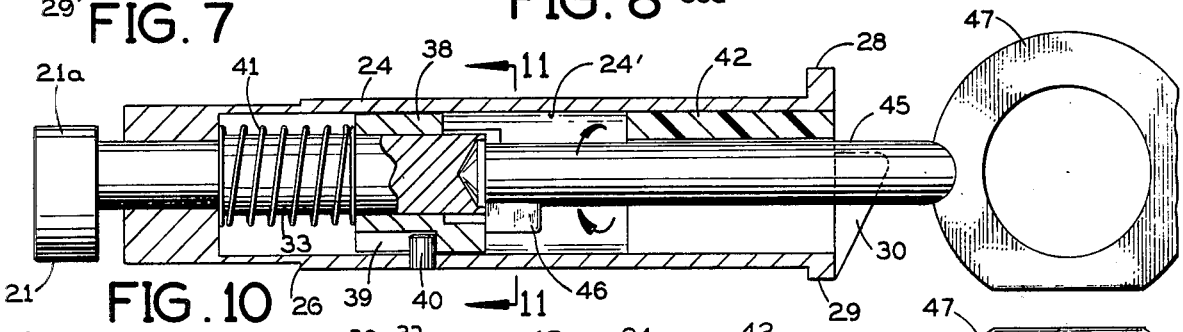
FIG. 10 is a horizontal longitudinal section through the lock assembly with the key fully inserted but not yet turned.

A coil spring 41 is engaged under compression between the front wall 31 of the lock housing 24 and the front end of the release slide 38 to bias the release slide the off-center shaft 33 rearward along the lock housing, as shown in FIGS. 6 and 9.

A key alignment plug 42 is tightly seated in the rear end of the bore 24' of the lock housing 24. This plug has a longitudinal keyhole 43 extending along its entire length with a cylindrical bore that is coaxial with the off-center shaft 33 and a narrower offset 43*a* (FIG. 3) of rectangular cross-section at one side of this cylindrical bore.

Figure 4:
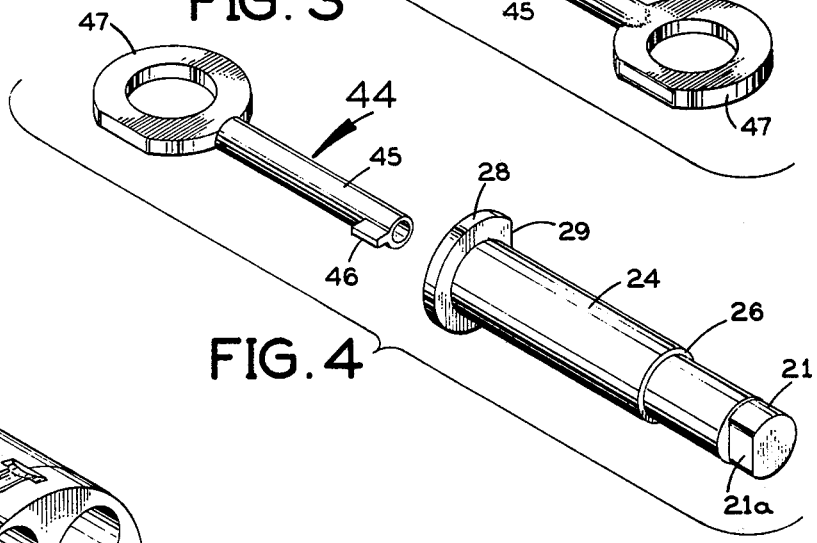
FIG. 4 is a view similar to FIG. 3 but taken from the front end of the lock assembly.
Figure 5:
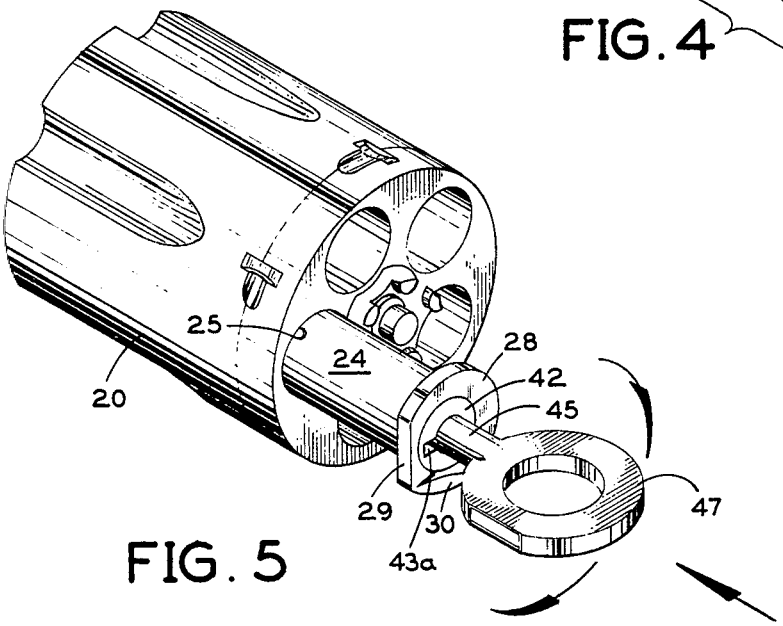
FIG. 5 is a fragmentary, perspective view showing the lock assembly partly inserted into a chamber of the gun cylinder.

A key 44, as shown in FIGS. 3 and 4, is insertable longitudinally through the keyhole bore 43 in the key alignment plug 42. This key has a cylindrical shank 45 which has a close, sliding fit in the cylindrical bore of the keyhole slot and a laterally offset, integral lug 46 on the front end of this shank which is slidable along the offset 43*a* in the keyhole slot. The key lug 46 also is slidably insertable into either slot 35 or 36 in the back end of the off-center shaft 33. The key lug 46 abuts against the back end of the rearwardly extending lip 38*c* on the release slide 38 when the key is inserted. The key has a handle 47 on the rear end of its shank.

FIG. 4 shows the eccentric lock 21 in its retracted or "unlock" position on the lock assembly. Throughout most of its peripheral extent the eccentric lock 21 has a cylindrical periphery which matches that of the adjacent, cylindrical, reduced front end of the lock housing 24. At one side of the periphery of the eccentric lock is cut away or reduced to present a flat surface 21*a* which is located laterally inward from the cylindrical outlne of the front end of the lock housing. This flat 21*a* on the eccentric lock 21 is on the opposite side of the lock assembly from the flat 29 on the rear end flange 28 of the lock housing.

The various parts of the lock assembly are positioned with respect to each other as shown in FIGS. 3, 4, 6 and 9 when it is to be inserted into the cylinder chamber 25. With the parts in this position, the lock assembly may be slid lengthwise into the cylinder chamber 25 from the back end of cylinder 20. During such insertion the eccentric lock 21 is in its retracted position (FIGS. 3 and 4) in which it is disposed completely within the peripheral outline of the lock housing 24, so that it is simply an extension of the front end of the lock housing and can pass slidably through the cylinder chamber 25. After the lock assembly has been fully inserted, the eccentric lock 21 on its front end is disposed immediately in front of the cylinder 20, as shown in FIG. 1, and the rest of the lock assembly except the back end flange 28 is snugly received in the cylinder chamber 25. The back end flange 28 extends immediately behind the cylinder 20, as shown in FIG. 1. The rear projection 30 on the lock housing has its shoulder 30*a* facing laterally inward toward the adjacent side of the gun body.

After the lock assembly has been inserted into the cylinder 20, the key 44 may be inserted into the lock assembly from the back end of the cylinder, with the offset lug 46 on its front end passing along the offset 43*a* in the keyhole slot 43 through the key alignment plug 42 until it reaches the position shown in phantom in FIG. 6 and in the full lines in FIG. 9. At this time the offset 43*a* in the keyhole slot 43 is aligned with the slot 36 in the enlarged rear end of the off-center shaft 33. Therefore, further longitudinal movement of the key 44 into the lock assembly will cause the key lug 46 to enter the slot 36 in shaft 33.

Shortly after it enters the slot 36 in shaft 33, the key lug 46 will engage the back end of the rearwardly projecting lip 38*c* on the release slide 38. Therefore, continued insertion of the key will displace the release slide 38 forward along the off-center shaft 33 (against the bias exerted by spring 41). The dowel pin 40 carried by the lock housing 24 permits such axial displacement of the release slide 38 but prevents it from turning, and the key lug 46 is guided along the slot 36 in the shaft 33. The sliding engagement between the flats 36*e* on the back end of the shaft 33 and the flat 38*e* on the back end of the release slide 38 prevents the shaft 33 from turning (slide 38 being restrained by dowel pin 40 against turning).

When the key 44 has been fully inserted into the key-receiving recess 34 in the back end of the off-center shaft 33, the release slide 38 will have been pushed forward along shaft 33 enough to disengage its flat 38*e* from the flats 36*e* on shaft 33. This disengagement or separation occurs before the closed end of slot 39 in the release slide 38 engages the dowel pin 40 to stop the forward movement of the release slide. As soon as such disengagement occurs the shaft 33 may be turned by turning the key 44.

However, preferably the user should continue to push the key 44 forward into the lock housing 24 until the release slide 38 strikes the dowel pin 40. This additional forward displacement of the release slide and the shaft 33 moves the eccentric lock 21 a short distance forward from the front end of the lock housing, as shown in full lines in FIG. 10.

Figure 11:
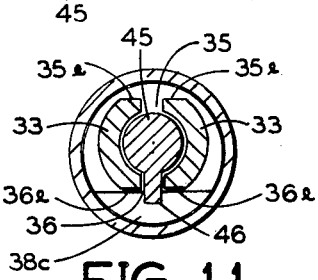
FIG. 11 is a cross-section taken along the line 11—11 in FIG. 10.
Figure 12:
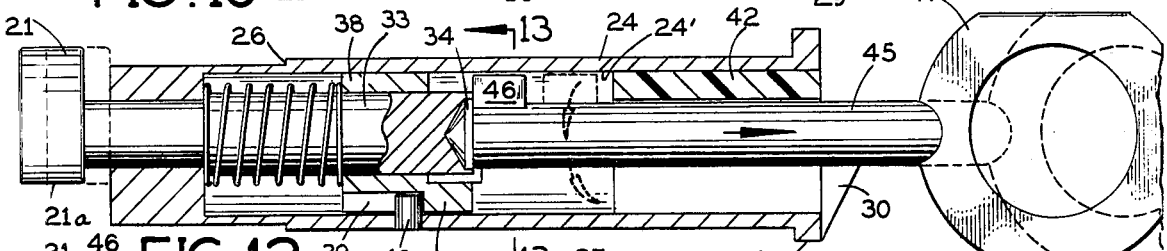
FIG. 12 is a veiw similar to FIG. 10 but with the key turned to put the lock assembly in its "lock" condition.
Figure 13:
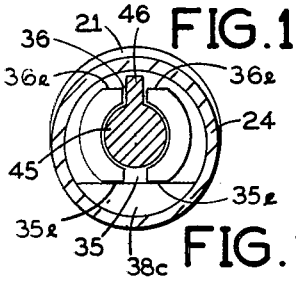
FIG. 13 is a cross-section taken along the line 13—13 in FIG. 12.

Now, the key may be turned through a half-turn to the position shown in FIGS. 11 and 12. In doing so it rotates the off-center shaft 33 in the same direction, so that now the eccentric lock 21 has been turned to the locking position, shown in FIG. 12.

With the parts in this position, the key 44 may be retracted axially to the phantom-line position in FIG. 12 in which it is disengaged from the off-center shaft 33. The spring 41 will now return the release slide 38 rearwardly to the position shown in FIG. 6, and as the release slide moves back its rearwardly facing shoulder 38*a* engages the forwardly-facing shoulders 33*a* on the off-center shat 33 so as to retract this shaft to the FIG. 6 position. When this happens the eccentric lock will reach the axial position shown in phantom in FIG. 12 and in full lines in FIG. 14. The rotational position of the eccentric lock is such that now it projects transversely beyond the peripheral outline of the lock housing 24. Therefore, it prevents the lock assembly from being removed from the cylinder 20. Also, as shown in FIG. 12, it is engageable with the gun body 22 if an attempt is made to rotate the cylinder 20, so that it locks the cylinder against turning.

Also, as shown in FIG. 14, the inclined surface of the rear extension 30 on the lock housing extends next to a surface 48 on the adjacent side of the gun body to prevent the cylinder 20 from turning.

In some models of guns, the shape of the gun body is such that the rear extension on the lock housing does not, of itself, restrain the cylinder against turning but the eccentric lock 21 will perform this function. In other types of guns, because of the shape of the gun body the eccentric lock 21 will not lock the cylinder against turning but the rear extension 30 will.

It should be noted that after the release slide 38 has been retracted by spring 41 the transverse flat 38*e* on its back end will be immediately contiguous to the flats 35*e* on the back end of shaft 13. Since the dowel pin 40 holds the release slide against turning, the shaft 33 cannot be turned either becuase of the close, confronting relationship between the respective flats 38*e* and 35*e*.

Next the key may be rotated one-half turn to bring its lug 46 into alignment again with the offset 43*a* in the keyhole slot 43 of the key alignment plug 42, and the key may be retracted completely out of the lock assembly.

When the user wants to release the eccentric lock 21 he simply re-inserts the key 44 as before except that this time the key lug 46 will be received in the other slot 35 in the off-center shaft 33. After the key has been fully inserted, it may be turned one-half turn to return the eccentric lock 21 to its unlocked position, and the lock assembly may be removed from the cartridge 20, if desired.

From the foregoing it will be apparent that the illustrated embodiment of this lock assembly is convenient and simple to use, as well as being particularly reliable in its operation because it has both the eccentric lock 21 on its front end and the locking projection 30 on its back end, one or both of which will perform its locking function on a wide variety of gun shapes and styles.

It is to be understood that the present locking device may be used to prevent the turning of a rotatable part in a mechanical apparatus or device other than the cylinder of a gun.

We claim:

1. A safety lock assembly for a gun having a rotatable cylinder, said lock assembly comprising:

a lock housing shaped and dimensioned for slidable insertion into a chamber of the cylinder;

an eccentric lock located at the front end of said lock housing and coupled to the latter for insertion in unison with the lock housing into said cylinder chamber to a position in front of the cylinder, said eccentric lock being rotatably adjustable between a retracted position in which it is disposed completely within the peripheral outline of said lock housing and a locking position in which it projects transversely beyond the peripheral outline of said lock housing a. for engagement laterally against the body of the gun to prevent rotation of the cylinder, and b. for engagement longitudinally against the front of the cylinder to prevent withdrawal of the lock housing therefrom;

and key-operated means in said lock housing accessible by a key inserted into the back end of the lock housing and operable by the key to turn the eccentric lock between said retracted and locking positions.

2. A safety lock assembly according to claim 1, wherein said key-operated means comprises a shaft rotatably mounted off-center in said lock housing, said shaft carrying said eccentric lock at its front end and having a key-receiving recess at its back end for coupling reception of a key to enable the shaft to be turned by the key.

3. A safety lock assembly according to claim 2, and further comprising guide means in said lock housing behind said shaft for guiding a key into said key-receiving recess at the back end of the shaft.

4. A safety lock according to claim 3, wherein:

said shaft has an external longitudinal slot therein which opens into said key-receiving recess and is open at the back end of the shaft;

said guide means has a keyway slot with an offset that registers with said slot in the shaft to guide the key into coupling engagement with the shaft.

5. A safety lock assembly according to claim 3, wherein:

said shaft has a pair of circumferentially spaced, longitudinal slots at the outside which open into said key-receiving recess and are open at the back end of the shaft;

and said guide means is a key alignment plug fixedly seated in the back end of said lock housing and having a longitudinal keyway extending therethrough, said keyway having an offset therein which registers with one of said slots in the shaft in the retracted position of said eccentric lock and registers with the other of said slots in the locking position of said eccentric lock.

6. A safety lock assembly according to claim 5, wherein:

said shaft is axially displaceable along said lock housing;

and further comprising:

spring means in said lock housing biasing said shaft rearwardly to position said eccentric lock substantially contiguous to the front end of said lock housing.

7. A safety lock assembly according to claim 5, wherein:

said key-operated means comprises a release slide which is slidable longitudinally along the inside of said lock housing and along the outside of said shaft, said release slide having a back end positioned for engagement by the key when the latter is partially inserted into said one slot to displace the release slide forwardly along said lock housing;

and further comprising:

spring means for returning the release slide rearwardly along the lock housing;

and wherein:

said shaft has a forwardly-facing external shoulder and said release slide has a rearwardly facing shoulder which is engageable with said shoulder on the shaft to retract the latter along the inside of the lock housing when the release slide is returned rearwardly along the lock housing.

8. A safety lock assembly according to claim 7, and further comprising means for stopping the forward movement of the release slide along the lock housing and the shaft after the key has been fully inserted in said key-receiving recess in the back end of the shaft and the shaft has been displaced forward along the lock housing to position said eccentric lock spaced in front of the front end of the lock housing.

9. A safety lock assembly according to claim 8, wherein said last-mentioned means prevents rotation of the release slide inside the lock housing.

10. A safety lock assembly according to claim 9, wherein said release slide and said shaft have transverse surfaces thereon which are immediately contiguous to one another during the initial forward displacement of the release slide along said lock housing to prevent the shaft from turning in the lock housing.

11. A safety lock assembly according to claim 9, wherein:

said release slide has a rear extension with a flat transverse surface thereon;

said release slide has a longitudinal external slot which is open at the front of the release slide and is closed rearwardly therefrom;

said means preventing rotation of the release slide comprises a dowel pin attached to the lock housing and projecting radially into said slot in the release slide;

and said shaft has flat transverse surfaces thereon adjacent said slots in the shaft which respectively extend contiguous to said flat surface on the release slide in said retracted and locking positions of the eccentric lock to prevent rotation of the shaft during the initial forward displacement of the release slide along said lock housing and during the retraction of the release slide by said spring means.

12. A safety lock assembly according to claim 1, and further comprising;

a locking projecton on the back end of said lock housing to be located beyond the cylinder when the lock housing is fully inserted in said cylinder chamber, for preventing the cylinder from turning.

13. A safety lock assembly according to claim 11, wherein:

said lock housing has a transverse flange on its back end which is located behind the cylinder when the lock housing is fully inserted in the cylinder chamber;

and said flange has a transverse projection on its back end for engagement against the body of the gun to prevent the cylinder from turning.

14. A safety lock assembly for a longitudinally chambered rotatable part on a mechanical apparatus, said lock assembly comprising:

a lock housing shaped and dimensioned for slidable insertion into a chamber of said rotatable part;

an eccentric lock located at one end of said lock housing and coupled to the latter for insertion in unison with the lock housing into said chamber to a position at one end of said rotatable part, said eccentric lock being rotatably adjustable between a retracted position in which it is disposed completely within the peripheral outlne of said lock housing and a locking position in which it projects transversely beyond the peripheral outline of said lock housing a. for engagement laterally against the apparatus to prevent rotation of said rotatable part, and b. for engagement longitudinally against said one end of said rotatable part to prevent withdrawal of the lock housing therefrom;

and key-operated means in said lock housing accessible by a key inserted into the opposite end of the lock housing and operable by the key to turn the eccentric lock between said retracted and locking positions.

15. A safety lock assembly assembly according to claim 14, and further comprising:

a locking projection on said opposite end of the lock housing to be located at said opposite end of said rotatable part when the lock housing is fully inserted in said chamber, for preventing said rotatable part from turning.

* * * * *